US006547158B1

(12) United States Patent
Smith

(10) Patent No.: US 6,547,158 B1
(45) Date of Patent: Apr. 15, 2003

(54) APPARATUS FOR APPLYING LINE STRIPING CHEMICALS AND REFLECTIVE BEADS TO A SURFACE

(75) Inventor: David C. Smith, Seminole, FL (US)

(73) Assignee: Ramp Engineering, Inc., St. Petersburg, FL (US)

( * ) Notice: Subject to any disclaimer, the term of this patent is extended or adjusted under 35 U.S.C. 154(b) by 0 days.

(21) Appl. No.: 10/194,600

(22) Filed: Jul. 12, 2002

(51) Int. Cl.[7] ..... B05B 1/28

(52) U.S. Cl. ..... 239/150; 239/151; 239/172; 404/93; 404/94

(58) Field of Search ..... 239/150, 151, 239/307, 304, 303, 308, 306, 407, 418, 433, 578, 146; 404/93, 94; 222/132, 608, 394, 630; 118/305

(56) References Cited

U.S. PATENT DOCUMENTS

| | | | | |
|---|---|---|---|---|
| 2,691,923 A | * | 10/1954 | Huck | 404/94 |
| 2,833,542 A | | 5/1958 | Martin | |
| 3,007,645 A | * | 11/1961 | Little | 239/150 |
| 3,057,273 A | | 10/1962 | Wilson | |
| 3,289,899 A | | 12/1966 | Miller et al. | |
| 3,844,669 A | | 10/1974 | Eigenmann | |
| 3,902,666 A | | 9/1975 | Ito et al. | |
| 4,256,261 A | | 3/1981 | Gurney | |
| 5,368,232 A | * | 11/1994 | Schroeder | 239/165 |
| 5,454,493 A | | 10/1995 | Laroche et al. | |
| 5,951,201 A | | 9/1999 | Jones | |
| 6,027,281 A | | 2/2000 | Neuling | |
| 6,149,341 A | * | 11/2000 | Neuling | 404/75 |
| 6,505,995 | * | 1/2003 | Sanfilippo et al. | 404/94 |

* cited by examiner

*Primary Examiner*—Steven O. Douglas
*Assistant Examiner*—Amanda Flynn
(74) *Attorney, Agent, or Firm*—Larson & Larson, PA; James E. Larson

(57) ABSTRACT

A three wheeled carriage supports an air compressor, a container for reflective glass beads and a primary hose enclosing secondary hoses delivering plural paint components to a spray gun. The three wheeled carriage has a handle bar operable by one person with three switches, one to control the flow of reflective glass beads to a bead spray gun, another to control the flow of paint components to form a stripe by external mix of the paint components and a third to control an angle of turn for a front wheel. A trailer follows the three wheeled carriage, the trailer containing an air compressor and receptacles for two paint components and input into the secondary hoses. Wheeled dollies support the primary hose between the trailer and the three wheeled carriage.

17 Claims, 5 Drawing Sheets

APPARATUS FOR APPLYING LINE STRIPING CHEMICALS AND REFLECTIVE BEADS TO A SURFACE

BACKGROUND OF THE INVENTION

This invention relates to apparatus for line striping. More particularly, it refers to an apparatus for applying two quick setting external mix chemical line striping components and reflective beads in a 2–8 inch stripe on a road or airport pad surface.

Typical line striping equipment employing two quick setting external mix chemical components has exhibited difficulty applying reflective glass beads prior to the set up of the two chemical components. If the reflective glass beads are not incorporated into the line striping components before the chemicals harden, the beads will not adhere to the dried material and will wash off with a heavy rain or traffic.

U.S. Pat. No. 2,691,923 describes an apparatus for the application of reflective glass beads to a paint spray. Although a three wheeled carriage supports both the bead container and paint container, the paint is not an external mix type used in modern day paint striping. Such an external mix paint requires two separate paint component containers which cannot be appropriately mounted on a three wheeled hand propelled carriage. Modern day paint striping applications have been carried out with complex equipment as shown in U.S. Pat. No. 5,951,201. Such equipment cannot be operated inexpensively on a three wheeled carriage.

An apparatus is needed which will incorporate reflective beads into an external mix chemical composition before it hardens so that the reflective beads are an integral part of the stripe and at the same time with an apparatus that can be inexpensively employed by a minimum number of operators.

SUMMARY OF THE INVENTION

The invention solves this problem by providing an apparatus that applies a reflective glass bead pattern to a two component external mix line striping pattern utilizing a minimum number of operators. A one-person operated three wheeled carriage has a handle bar supporting switches to control the flow of an external mix two component paint mixture to a spray gun at a front portion of the carriage. The carriage also supports a container for reflective glass beads and a compressor for propelling the beads outwardly under air pressure to a bead spray gun spraying the beads in a pattern over wet paint. A T-bar supports a hose containing the paint component supply which emanates from a trailer following the three wheeled carriage. A multiplicity of wheeled dollies support a hose between the carriage and the trailer carrying the two component paint in separate containers and its air compressor.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
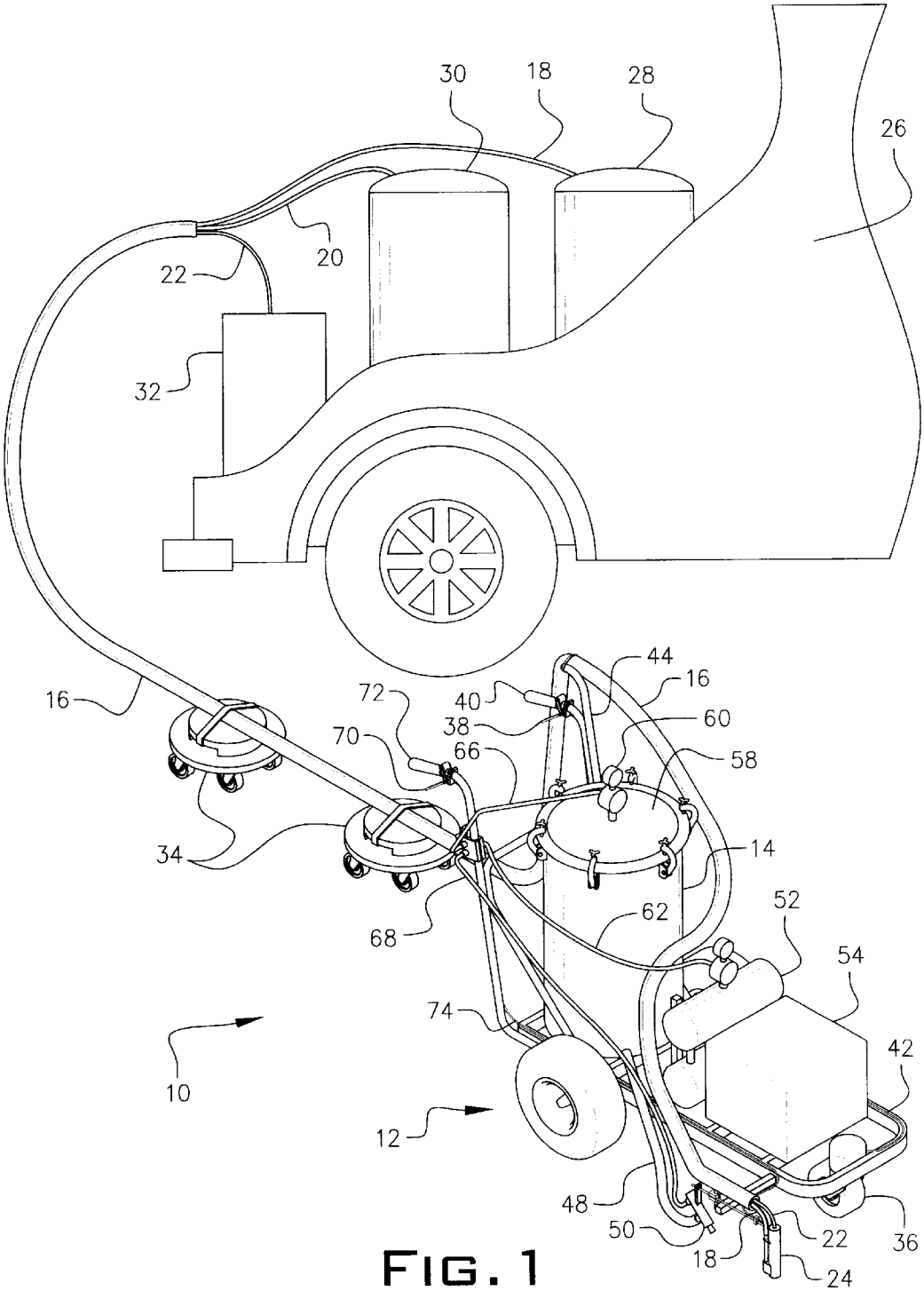
FIG. 1 is a diagrammatic description of the apparatus of this invention.

Throughout the following detailed description, the same reference numerals refer to the same elements in all figures.

Referring to FIG. 1, the line striping apparatus 10 of this invention includes a first multi-wheeled carriage 12, a container 14 for reflective glass beads, a primary hose 16 enclosing three hoses; namely, a secondary hose 18 for conveying a first paint component, another secondary hose 20 for conveying a second paint component and a hose 22 for conveying air under pressure to the paint spray gun 24. A second multi-wheeled carriage 26 transports a first paint component container 28, a second paint component container 30 and an air compressor 32. Multiple wheeled dollies 34 support hose 16 between the second multi-wheeled carriage 26 and the first multi-wheeled carriage 12. Hose 16 is supported on carriage 12 by a T-bar 44.

Figure 2:
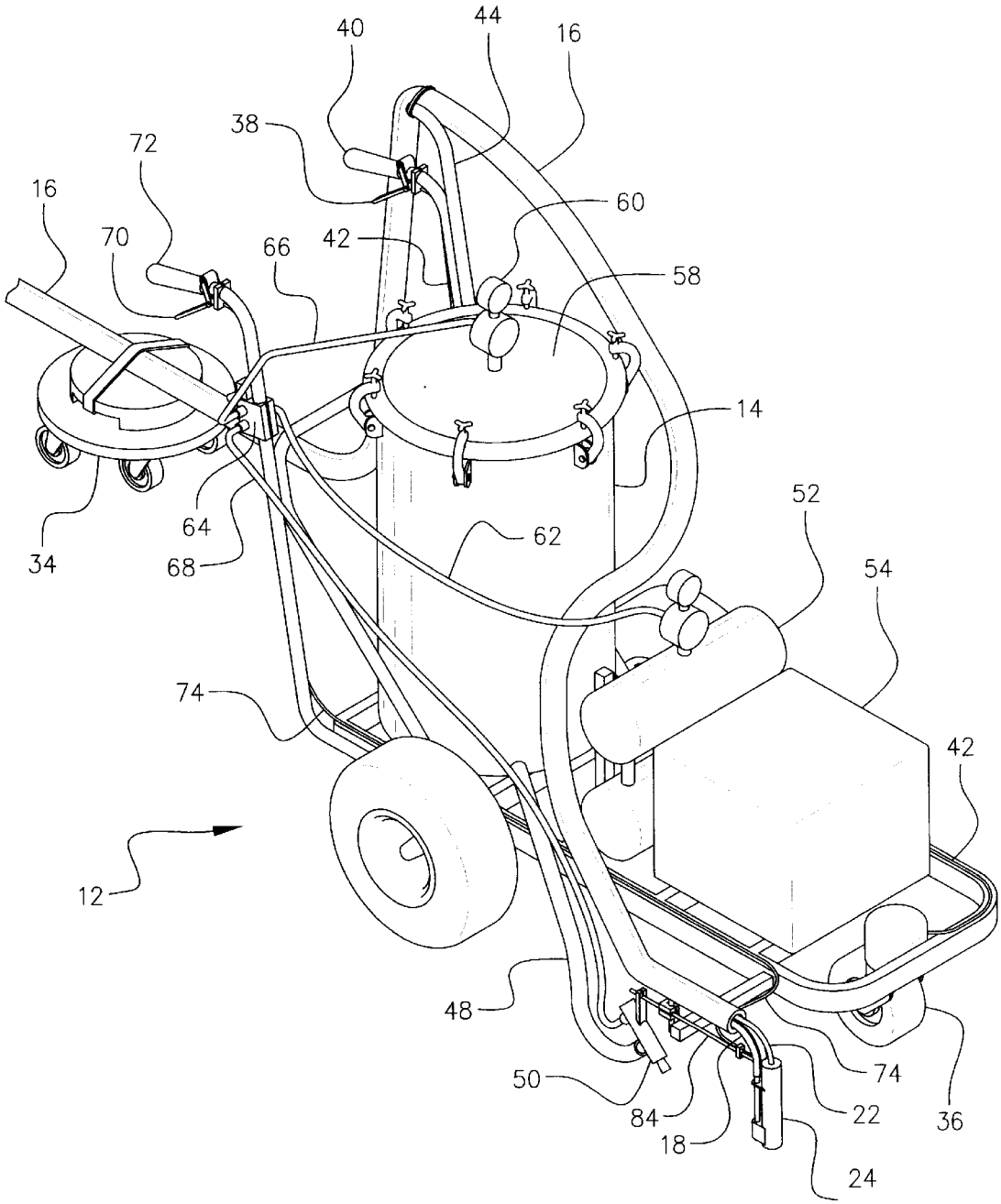
FIG. 2 is a prospective view of the first multi-wheeled carriage and a wheeled dolly supporting the hose transporting the line striping paint components employed in the apparatus.

Referring to FIG. 2, the first multi-wheeled carriage 12 is preferably a three wheeled unit with a front wheel 36 locked in position in response to release of handle bar wheel switch 38. When switch 38 is squeezed towards handle bar 40, wheel cable 42 allows wheel 36 to be turned to the right from a straight away position as seen in FIG. 2. Once wheel 36 is set in the correct direction, release of switch 38 locks wheel 36 in position.

Figure 4:
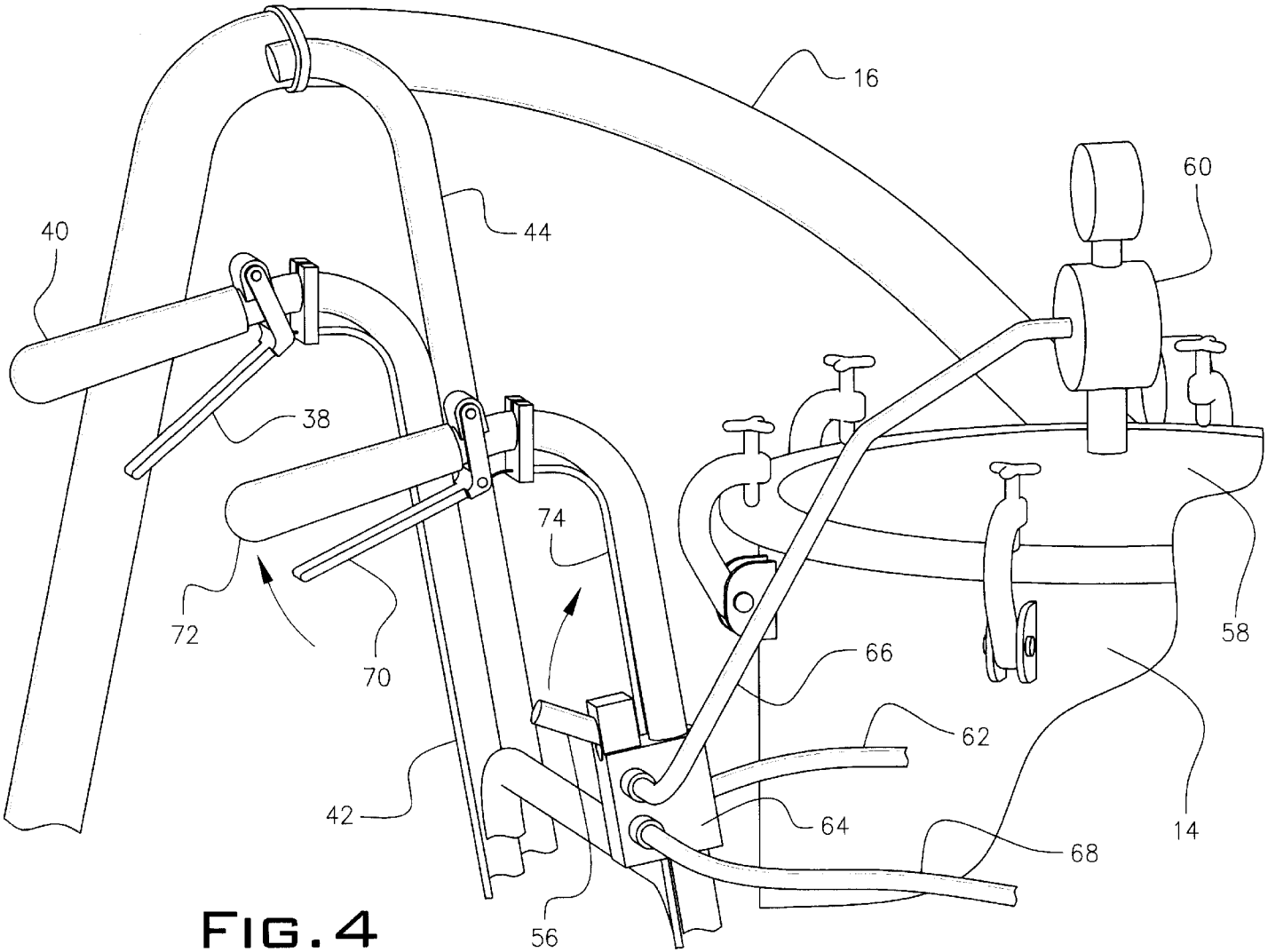
FIG. 4 is an enlarged view of the handle bar actuating levers' position when line striping is ongoing.

Reflective glass spheres 46 are sprayed from container 14 through hose 48 to the bead spray gun 50. The bead dedicated air compressor 52 activated by motor 54 on carriage 12 sends the beads 46 under air pressure from the container 14 when the on/off switch 56 is activated as seen in FIG. 4. Container 14 has a pressure lid 58 with suitable pressure gauges 60 to keep the beads 46 continuously flowing from container 14 when switch 56 is on. Air pressure line 62 from the compressor 52 leads to switch housing 64. The air pressure is then diverted one-half via line 66 to pressure gauges 60 and to container 14 and one-half via line 68 to bead spray gun 50.

Handle bar switch 70 on handle bar 72 lifts up as seen in FIG. 4 to cause actuator line 74 to open a valve in paint spray gun 24 to permit flow of the paint components propelled by air pressure from line 22. The paint components do not mix until sprayed from spray gun 24.

Figure 3:
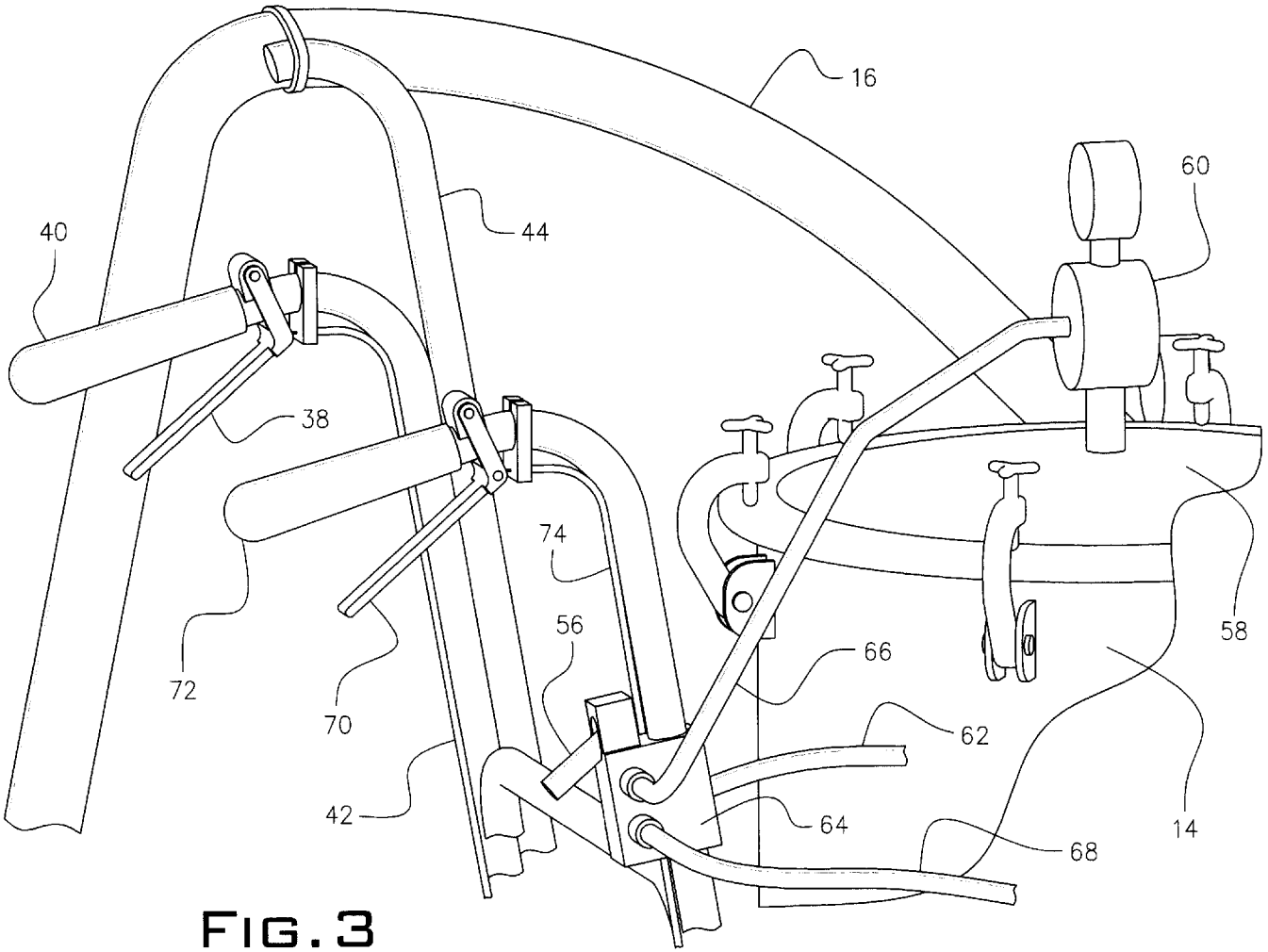
FIG. 3 is an enlarged view of the handle bar actuating levers at rest.
Figure 5:
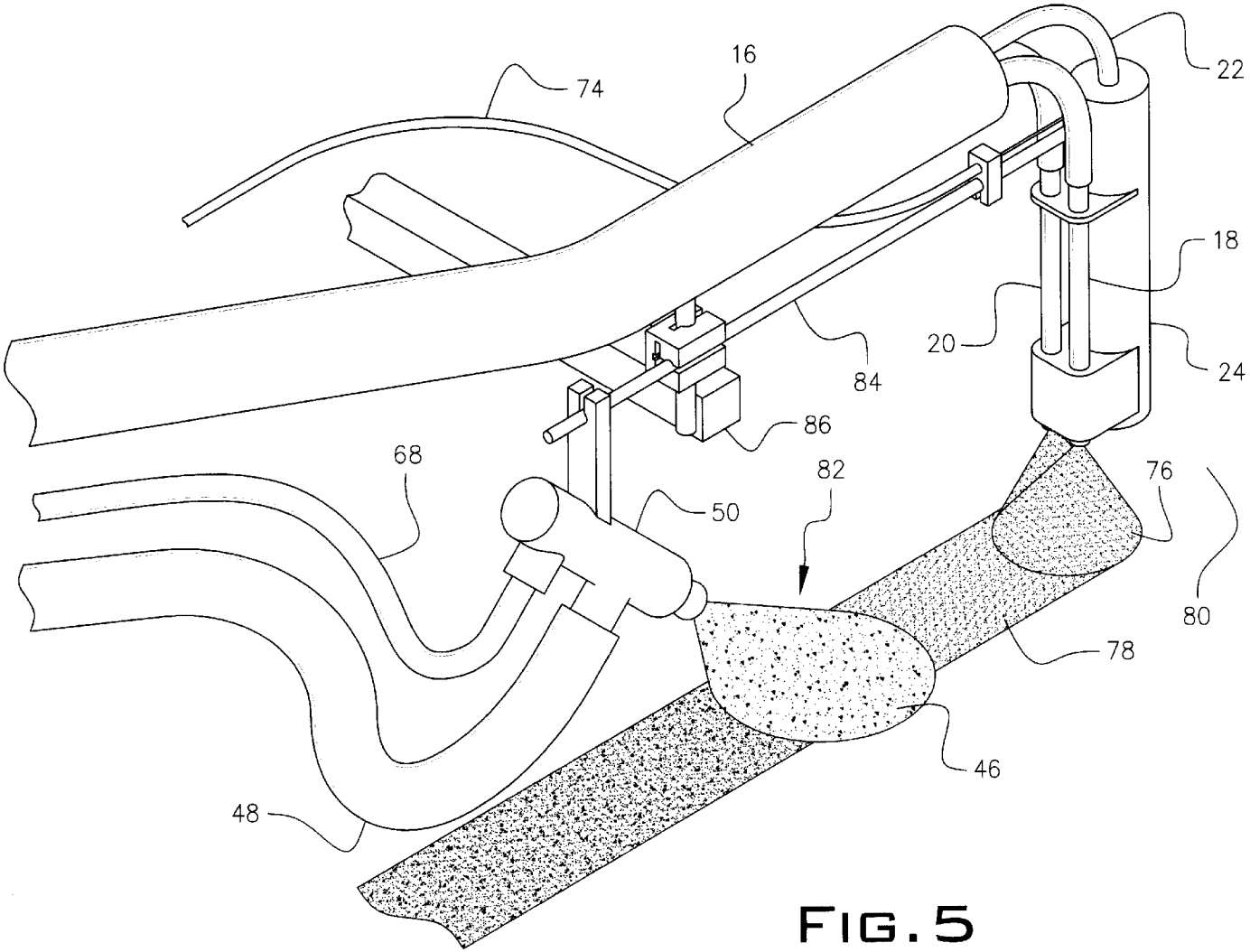
FIG. 5 is an enlarged view of the line striping spray guns during a striping operation.

Referring to FIGS. 3 and 4, a single operator can walk behind handle bars 40 and 72. As the operator moves forward, wheel switch 38 is actuated to position wheel 36 in the correct direction. For a circle such as an airport ramp area, the wheel is directed to the right and then wheel switch 38 is released to retain a fixed position for the wheel 36. The operator then lifts on/off switch 56 upwardly to activate the compressor 52 to eject beads 46 by air pressure out of bead gun 50. At the same time, the operator lifts handle bar switch 70 upwardly to permit flow of the two paint components out of paint spray gun 24. Air pressure is exerted from compressor Referring to FIG. 5, the spray gun 24 fires a two component paint spray external mix pattern 76 to create a 2–8 inch stripe 78 on road surface 80. The bead pattern 82 spreads out beyond the paint pattern 76, but will only stick to the paint stripe 78. The bead spray gun 50 must be spaced closely behind (within one yard) from the paint spray gun 24 to ensure sticking of the beads 46 to the paint stripe 78. Support rod 84 resting on carriage frame member 86 retains the bead gun 50 and paint spray gun 24 spaced apart at a desired distance.

Referring again to FIG. 1, the container 28 contains one component of a two component external mix material for line striping. This component can be Polyshield/Polyurea Group including AMP-100®, F-AMP® sold by Specialty Products, Inc. of Lakewood, Wash. Container 30 contains a mixture of 4, 4'-diphenylmethane diisocyanate, also sold by Specialty Products, Inc.

Carriage 26 is preferably a trailer of sufficient size to support the containers 28 and 30 and air compressor 32, together with the hoses 18, 20 and 22 enclosed within primary hose 16. Dollies 34 support hose 16 between trailer 26 and the three wheeled carriage 12. The trailer 26 moves with carriage 12 during the line striping operation. Reflective beads 46 can be any commercially available bead as set forth in U.S. Pat. No. 5,951,201. The spreading of the reflective beads 46 is simultaneous with the application of the two paint components so that the quick drying paint receives the reflective beads before the paint dries. The inventive apparatus 10 permits a single operator to line stripe with the three wheeled carriage 12 in any straight or curved configuration.

Other equivalent elements can be substituted for the elements disclosed herein to produce the same results in the same way.

Having described the invention in detail the following are the claims:

1. An apparatus for applying reflective glass beads and an external mix two component paint stripe to a surface comprising:

a first multi-wheeled carriage supporting an air compressor, a container for reflective glass beads and a primary hose for conveying the two component paint to a paint delivery spray gun directed towards the surface;

a handle bar on the first multi-wheeled carriage mounting a first on/off switch for controlling delivery of the reflective glass beads from the container to a spray device located directly behind the paint delivery spray gun;

a second on/off switch mounted on the handle bar for a controlling delivery of the two component paint to a spray gun;

a second multi-wheeled carriage for supplying the two component paint by way of a primary hose to the spray gun; and a means for supporting the primary hose between the second multi-wheeled carriage and the first multi-wheeled carriage.

2. The apparatus according to claim 1 wherein the first multi-wheeled carriage has three wheels.

3. The apparatus according to claim 2 wherein the primary hose for conveying the two component paint encloses at least two secondary hoses each containing a different paint component and an air hose.

4. The apparatus according to claim 3 wherein the primary hose is supported on the three wheeled carriage by an upstanding T-bar.

5. The apparatus according to claim 1 wherein the second multi-wheeled carriage is a trailer enclosing containers for each paint component and a secondary hose leading from each container to outside of the trailer where the secondary hoses are enclosed within the primary hose.

6. The apparatus according to claim 1 wherein the means for supporting the primary hose between the second and first multi-wheeled carriage are multiple wheeled dollies.

7. The apparatus according to claim 1 wherein the surface to which the two component paint and reflective glass beads are applied is an airport ramp area.

8. A system for applying reflective glass beads to a wet external mix two component paint stripe applied to a surface comprising:

a first multi-wheeled carriage supporting an air compressor, a container for reflective glass beads and a primary hose attached at an output end to a paint delivery spray gun directed towards the surface;

a handle bar on the first multi-wheeled carriage mounting a first on/off switch for controlling delivery of the reflective glass beads from the container to a spray device located directly behind the paint spray gun;

a second on/off switch mounted on the handle bar for controlling delivery of the two component paint to the paint spray gun;

a second multi-wheeled carriage for supplying the two component paint by way of secondary hoses within a primary hose to the paint spray gun; and a means for supporting the primary hose between the second multi-wheeled carriage and the first multi-wheeled carriage.

9. The system according to claim 8 wherein the first multi-wheeled carriage is provided with three wheels.

10. The system according to claim 9 wherein the primary hose encloses one secondary hose transporting a first paint component and another secondary hose transporting a second paint component.

11. The system according to claim 9 wherein the primary hose is supported on the three wheeled carriage by an upstanding T-bar.

12. The system according to claim 10 wherein the second multi-wheeled carriage is a trailer enclosing receptacles for each paint component with the secondary hoses leading from the receptacles for the paint components to outside the trailer where the secondary hoses are enclosed within the primary hose.

13. The system according to claim 8 wherein the means for supporting the primary hose between the second and first multi-wheeled carriage are a plurality of wheeled dollies that move in response to movement of the first multi-wheeled carriage.

14. The system according to claim 8 wherein a stripe is formed on an airport ramp area or road surface with the two component paint and glass beads, the stripe formed by a circular movement of the first wheeled carriage upon actuation of the first and second on switch.

15. The system according to claim 8 wherein the reflective glass beads are ejected from the container under air pressure upon actuation of the on/off switch.

16. The system according to claim 9 wherein a front wheel of the three wheeled carriage is retained in a fixed position by release of a switch mounted on the handle bar.

17. A method of providing a reflective stripe on a surface receiving vehicle traffic, the method comprising;

(a) providing a three wheeled carriage having a front wheel fixed in a desired angle of turn by releasing a wheel switch mounted on a handle bar of the carriage;

(b) mounting a container for reflective glass beads, an air compressor, and a T-bar for supporting a primary hose on the three wheeled carriage;

(c) mounting an external mix paint spray gun on a front portion of the three wheeled carriage and mounting a reflective bead spray gun rearward and adjacent the paint spray gun;

(d) actuating a bead switch mounted on the handle bar of the carriage to spray beads on a paint stripe created by a two component paint material emanating from the paint spray gun, the paint components each emanating from a secondary hose enclosed by the primary hose, the spray gun actuated by a paint spray gun switch mounted on the handle bar of the carriage;

(e) providing a trailer to accompany the three wheeled carriage, the trailer containing a first receptacle for a first paint component, a second receptacle for a second paint component and an air compressor for propelling the first paint component through a first secondary hose and the second paint component through a second secondary hose to the paint spray gun, the secondary hoses enclosed by the primary hose supported by wheeled dollies moving between the trailer and the three wheeled carriage; and (f) actuating the bead switch moments before actuating the paint spray gun switch so that reflective glass beads are striking the surface as the two component paint forms a line stripe.

* * * * *